US011694637B2

(12) United States Patent
Yoo et al.

(10) Patent No.: US 11,694,637 B2
(45) Date of Patent: Jul. 4, 2023

(54) DISPLAY DEVICE

(71) Applicant: SAMSUNG DISPLAY CO., LTD., Yongin-si (KR)

(72) Inventors: Young Wook Yoo, Yongin-si (KR); Pil Ho Kim, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/860,278

(22) Filed: Jul. 8, 2022

(65) Prior Publication Data

US 2023/0008470 A1 Jan. 12, 2023

(30) Foreign Application Priority Data

Jul. 9, 2021 (KR) ..... 10-2021-0090584

(51) Int. Cl.
*G09G 3/3291* (2016.01)

(52) U.S. Cl.
CPC ... *G09G 3/3291* (2013.01); *G09G 2300/0426* (2013.01); *G09G 2300/0842* (2013.01); *G09G 2300/0861* (2013.01); *G09G 2330/021* (2013.01)

(58) Field of Classification Search
None
See application file for complete search history.

(56) References Cited

U.S. PATENT DOCUMENTS

2019/0371226 A1* 12/2019 Iwaki ..... H01L 27/1225
2020/0051211 A1* 2/2020 Shiokawa ..... G06T 3/4046
2021/0098300 A1* 4/2021 Kusunoki ..... G09G 5/399
2021/0390382 A1* 12/2021 Kwon ..... G06N 3/065
2022/0067515 A1* 3/2022 Yoo ..... G09G 3/3233

FOREIGN PATENT DOCUMENTS

KR 10-2022-0027382 3/2022

* cited by examiner

*Primary Examiner* — Sepehr Azari
(74) *Attorney, Agent, or Firm* — F. Chau & Associates, LLC

(57) ABSTRACT

A display device according to an embodiment includes a plurality of pixel blocks including a plurality of pixels connected to a plurality of scan lines and a plurality of data lines, respectively, and at least one active circuit; and a data driver supplying a data voltage to the plurality of data lines in a light emitting mode and supplying a neural network input signal to the plurality of data lines in an artificial neural network mode. In the artificial neural network mode, a scan signal is supplied to a scan line connected to at least one pixel block among the plurality of pixel blocks, and the neural network input signal is supplied to a data line connected to the at least one pixel block.

20 Claims, 11 Drawing Sheets

DISPLAY DEVICE

CROSS-REFERENCE TO RELATED APPLICATION

The application claims priority under 35 U.S.C. § 119 to Korean Patent Application No. 10-2021-0090584, filed Jul. 9, 2021, the disclosure of which is incorporated by reference herein in its entirety.

TECHNICAL FIELD

The present invention relates to a display device.

DISCUSSION OF RELATED ART

A display device is an output device for presentation of information in visual form. As interest in information display increases and portable information media increases, display devices are being intensively used in various electronic devices such as smartphones, digital cameras, notebook computers, navigation systems and smart televisions.

Artificial intelligence systems, which simulate functions such as cognition and judgment of the human brain by using machine learning algorithms such as deep learning, are being applied in various fields. For example, attempts are being made to apply such artificial intelligence systems to display devices.

SUMMARY

An embodiment provides a display device capable of driving a display panel by dividing the display panel into pixel blocks.

A display device according to an embodiment may include a display device including: a plurality of pixel blocks including a plurality of pixels connected to a plurality of scan lines and a plurality of data lines, respectively, and at least one active circuit; and a data driver for supplying a data voltage to the plurality of data lines in a light emitting mode and for supplying a neural network input signal to the plurality of data lines in an artificial neural network mode, wherein a scan signal is supplied to a scan line connected to at least one pixel block among the plurality of pixel blocks in the artificial neural network mode, and the neural network input signal is supplied to a data line connected to the at least one pixel block in the artificial neural network mode.

The plurality of pixel blocks may be arranged in a matrix in a first direction and a second direction perpendicular to the first direction.

The plurality of pixel blocks may be arranged adjacent to each other in the first direction, and the plurality of pixel blocks may be driven in the artificial neural network mode in the first direction.

The plurality of pixel blocks may be arranged adjacent to each other in the second direction, and the plurality of pixel blocks may be driven in the artificial neural network mode in the second direction.

Some of the pixel blocks among the plurality of pixel blocks overlap at least partially in the first direction, and the plurality of pixel blocks may be driven in the artificial neural network mode in the first direction.

The artificial neural network mode may use a convolutional neural network.

The convolutional neural network may include an input layer, a first convolution layer, a first pooling layer, and a fully connected layer.

The input layer may include the plurality of pixel blocks and may correlate data corresponding to one pixel block among the plurality of pixel blocks to the first convolution layer.

The first convolution layer may include characteristic values of pixels on which a convolution operation is performed on pixel values of the input layer, and the characteristic values of the pixels may be values calculated using the plurality of pixels and at least one of the active circuits in the first convolution layer.

The first convolution layer may include at least one feature map, and the characteristic values of the pixels on which the convolution operation is performed using a kernel may be stored in the at least one feature map.

The first pooling layer may down-sample the at least one feature map, and the fully connected layer may output an output value calculated using the first convolution layer and the first pooling layer.

A display device according to an embodiment may include a display device including: a plurality of pixel blocks including a plurality of pixels connected to a plurality of scan lines and a plurality of data lines, respectively, and at least one active circuit; a data driver for supplying a data voltage to the plurality of data lines in a first mode and for supplying a neural network input signal to the plurality of data lines in a second mode; and a timing controller for supplying a weight control signal generated by reflecting a predetermined weight for performing a deep learning operation using at least one pixel among the plurality of pixels to the data driver, wherein, a scan signal is supplied to a scan line connected to at least one pixel block among the plurality of pixel blocks in the second mode, and the neural network input signal is supplied to a data line connected to the at least one pixel block in the second mode.

The plurality of pixels may include a plurality of first pixels and a plurality of second pixels, the plurality of first pixels and the plurality of second pixels may emit light in the first mode, and the plurality of second pixels may perform the deep learning operation in the second mode.

The active circuit may be connected to the plurality of second pixels, the active circuit may receive an active current corresponding to the deep learning operation from the plurality of second pixels connected thereto, and supply a neural network output voltage corresponding to the active current to the timing controller, and the timing controller may generate the weight control signal by reflecting the predetermined weight to the neural network output voltage.

The plurality of pixel blocks may be arranged in a matrix in a first direction and a second direction perpendicular to the first direction.

The plurality of pixel blocks may be arranged adjacent to each other in the first direction, and the plurality of pixel blocks may be driven in the second mode in the first direction.

The plurality of pixel blocks may be arranged adjacent to each other in the second direction, and the plurality of pixel blocks may be driven in the second mode in the second direction.

Some of the pixel blocks among the plurality of pixel blocks may overlap at least partially in the first direction, and the plurality of pixel blocks may be driven in the second mode in the first direction.

The second mode may use a convolutional neural network, and the convolutional neural network may include an input layer, a first convolution layer, a first pooling layer, and a fully connected layer.

The input layer may include the plurality of pixel blocks and correlate data corresponding to one pixel block among the plurality of pixel blocks to the first convolution layer.

DETAILED DESCRIPTION OF THE EMBODIMENTS

Example embodiments will now be described more fully with reference to the accompanying drawings. However, the present invention may be embodied in different forms and should not be construed as limited to the embodiments set forth herein.

It will be understood that, although the terms "first", "second", etc. may be used herein to describe various elements, these elements should not be limited by these terms. These terms are only used to distinguish one element from another element. For instance, a first element discussed below could be termed a second element. Similarly, the second element could also be termed the first element. In this disclosure, the singular expressions are intended to include the plural expressions, unless the context clearly indicates otherwise.

It will be further understood that the terms "comprise", "include", "have", etc. used in this disclosure, specify the presence of stated features, integers, steps, operations, elements, components, and/or combinations of them but do not preclude the presence or addition of one or more other features, integers, steps, operations, elements, components, and/or combinations thereof. Furthermore, when a first part such as a layer, a film, a region, or a plate is disposed on a second part, the first part may be not only directly on the second part but a third part may intervene between them. In addition, when it is expressed that a first part such as a layer, a film, a region, or a plate is formed on a second part, the surface of the second part on which the first part is formed is not limited to an upper surface of the second part but may include other surfaces such as a side surface or a lower surface of the second part. In addition, when a first part such as a layer, a film, a region, or a plate is under a second part, the first part may be not only directly under the second part but a third part may intervene between them.

Figure 1:
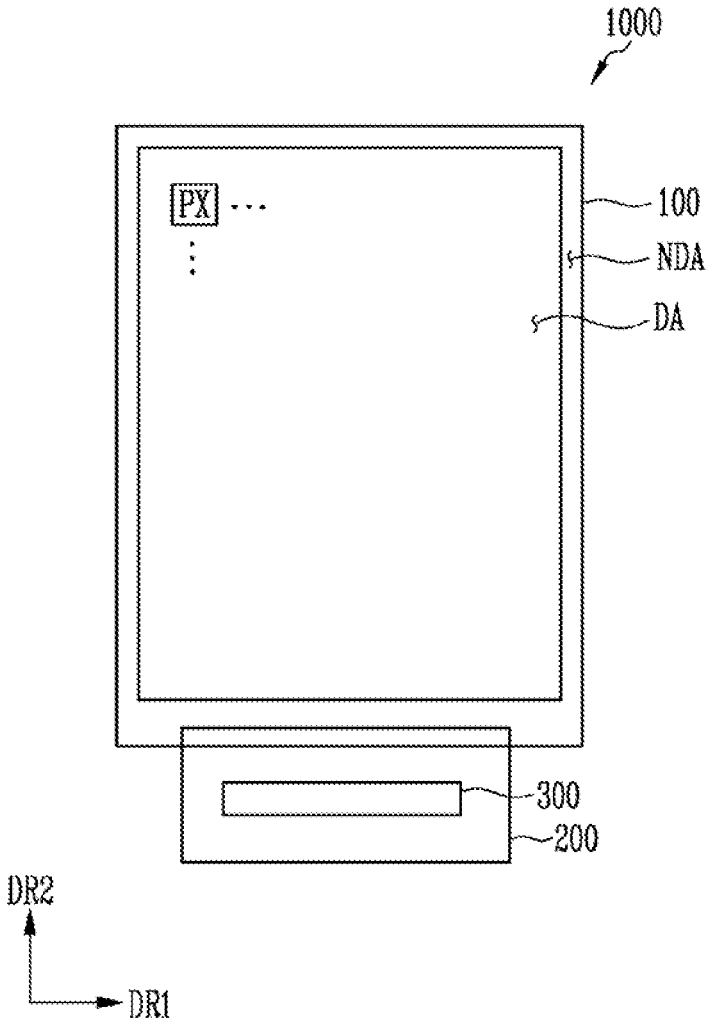
FIG. 1 is a plan view schematically illustrating a display device according to an embodiment.

FIG. 1 is a plan view schematically illustrating a display device according to an embodiment.

Referring to FIG. 1, a display device 1000 according to an embodiment may include a display panel 100, a connection film 200, and a driving chip 300.

In an embodiment, the display device 1000 may be a flat panel display device implemented as a liquid crystal display device or a light emitting display device, a flexible display device, a curved display device, a foldable display device, and a bendable display device. In addition, the display device 1000 may be applied to a transparent display device, a head-mounted display device, a wearable display device, and the like.

The display panel 100 may include a display area DA and a non-display area NDA. The display area DA may be an area including a plurality of pixels PX to display an image, and the non-display area NDA may be an area excluding the display area DA and may be an area in which an image is not displayed. The non-display area NDA may be a bezel area surrounding the display area DA. The non-display area NDA may also be disposed on less than four sides of the display area DA.

The non-display area NDA may be positioned around the display area DA to surround the display area DA, and may selectively include lines, pads, and a driving circuit connected to the pixels PX of the display area DA. For example, scan lines, data lines, driving voltage lines, driving low voltage lines, and the like connected to the plurality of pixels PX may be disposed in the non-display area NDA.

The connection film 200 may be positioned on one side of the display panel 100. In other words, the connection film 200 may be positioned on a first side of the display panel 100. For example, the connection film 200 may be positioned below the non-display area NDA of the display panel 100 in a second direction DR2, but the present invention is not limited thereto.

The driving chip 300 for driving the plurality of pixels PX may be disposed on the connection film 200. The driving chip 300 may include a scan driver that applies a scan signal to the plurality of pixels PX, an emission control driver that applies an emission control signal, a neural network driver, a data driver that applies a data voltage, a timing controller, and the like. However, the present invention is not limited thereto.

The connection film 200 may connect the display panel 100 and a flexible circuit board (FPCB). According to an embodiment, the connection film 200 may be implemented in various configurations such as a chip on film, a chip on glass, a chip on plastic, a tape carrier package, and the like.

In addition, according to an embodiment, the above-described scan driver, emission control driver, neural network driver, data driver, timing controller, and the like may be included in a separate integrated circuit chip (IC Chip) mounted on the flexible circuit board.

Hereinafter, a configuration capable of driving a pixel of the display device will be described with reference to FIGS. 2 and 3.

Figure 2:
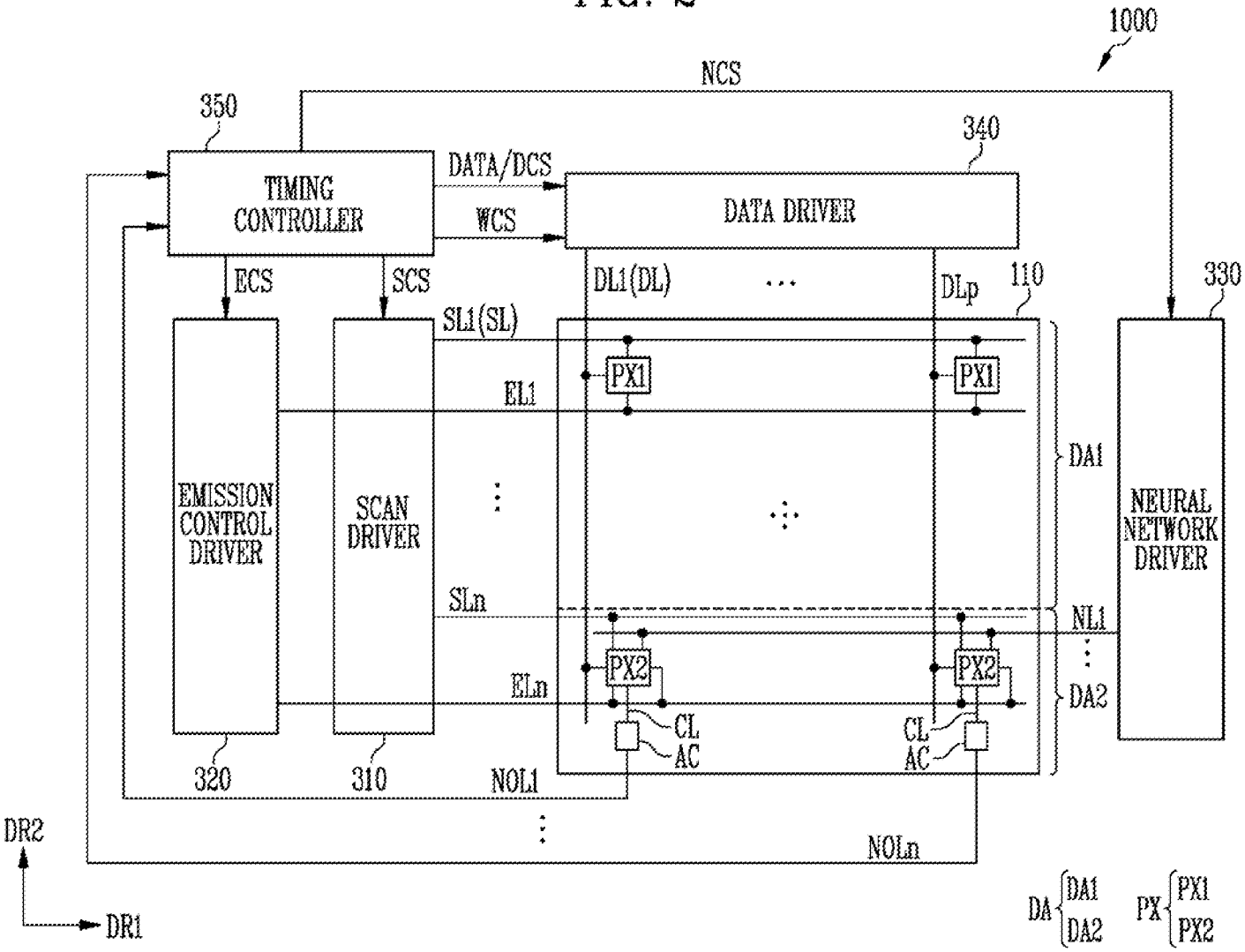
FIGS. 2 and 3 are block diagrams schematically illustrating the display device according to an embodiment.
Figure 3:
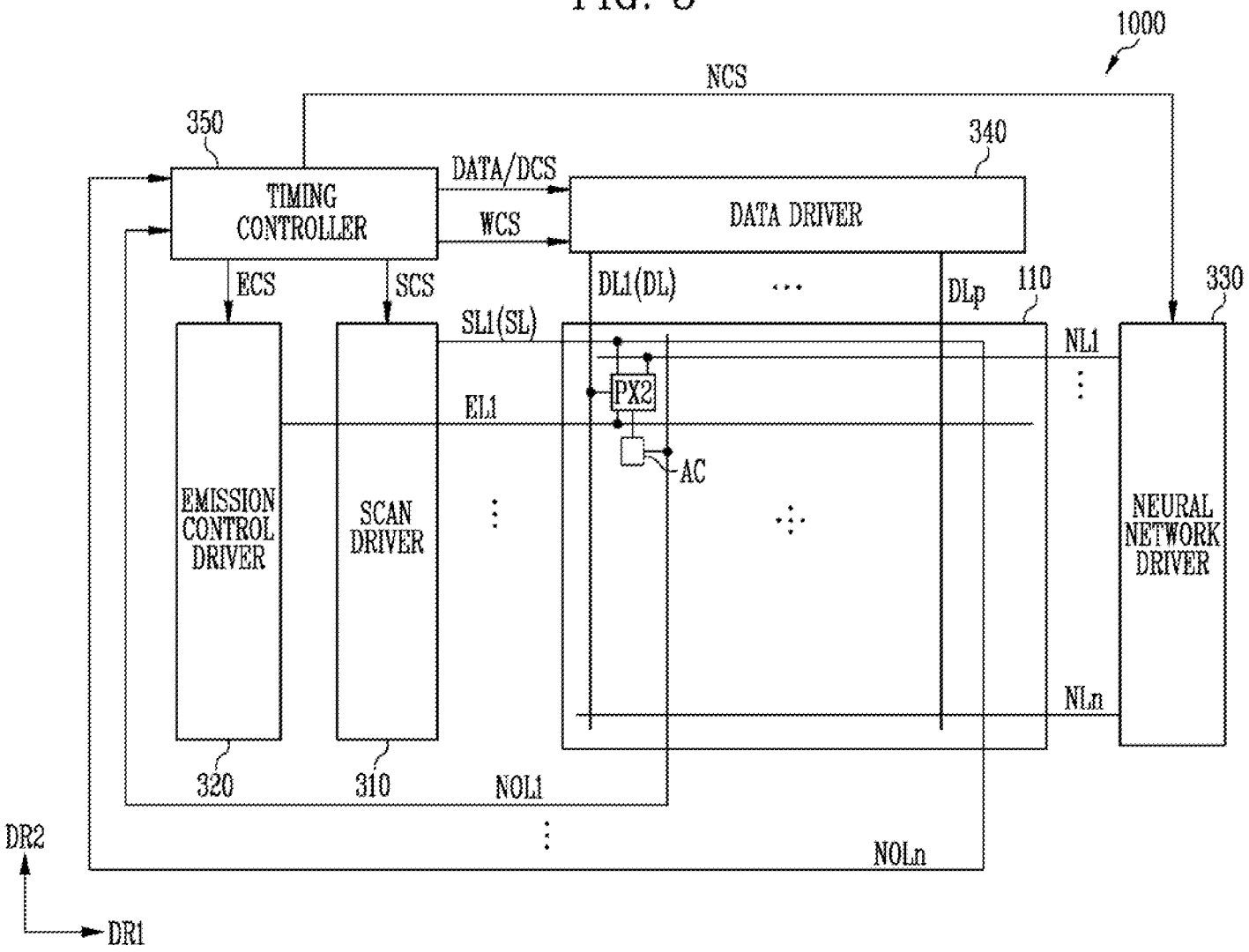

FIGS. 2 and 3 are block diagrams schematically illustrating the display device according to an embodiment.

Referring to FIGS. 2 and 3, the display device 1000 according to an embodiment may include a display unit 110, a scan driver 310, an emission control driver 320, a neural network driver 330, a data driver 340, and a timing controller 350.

The display unit 110 may be formed in the display panel 100 and may correspond to the display area DA of FIG. 1.

The display unit 110 may include a plurality of scan lines SL1 to SLn, a plurality of emission control lines EL1 to ELn, a plurality of neural network control lines NL1 to NLn, a plurality of data lines DL1 to DLp, a plurality of connection lines CL, and a plurality of neural network output lines NOL1 to NOLn. In addition, the display unit 110 may include a pixel PX connected to at least one of the plurality of scan lines SL1 to SLn, the plurality of emission control lines EL1 to ELn, the plurality of neural network control lines NL1 to NLn, and the plurality of data lines DL1 to DLp. Here, the plurality of scan lines SL1 to SLn, the plurality of emission control lines EL1 to ELn, and the plurality of neural network control lines NL1 to NLn may extend in a first direction DR1. The plurality of data lines DL1 to DLp may extend in the second direction DR2 perpendicular to the first direction DR1.

The plurality of pixels PX may include a plurality of first pixels PX1 and a plurality of second pixels PX2 that are divided according to connected lines. The plurality of first pixels PX1 may be connected to the plurality of scan lines SL1 to SLn, the plurality of emission control lines EL1 to ELn, and the plurality of data lines DL1 to DLp, respectively. The plurality of second pixels PX2 may be connected to the plurality of scan lines SL1 to SLn, the plurality of data lines DL1 to DLp, the plurality of emission control lines EL1 to ELn, the plurality of neural network control lines NL1 to NLn, and the plurality of connection lines CL, respectively. In other words, the plurality of second pixels PX2 may be connected to more lines than the plurality of first pixels PX1.

In an embodiment, referring to FIG. 2, the display unit 110 may include a first area DA1 in which the plurality of first pixels PX1 are disposed, and a second area DA2 in which the plurality of second pixels PX2 and an active circuit AC are disposed. For example, the first area DA1 and the second area DA2 may be adjacent to each other in the second direction DR2. According to an embodiment, the active circuit AC may be disposed in the non-display area NDA of the display panel 100 (refer to FIG. 1).

In addition, according to an embodiment, as shown in FIG. 3, the plurality of second pixels PX2 and the active circuit AC may be disposed over the entire display unit 110.

A first pixel PX1 and a second pixel PX2 may include at least one transistor and a capacitor for providing a driving current to a light emitting element. Accordingly, the first pixel PX1 and the second pixel PX2 may emit light with a luminance corresponding to the data voltage (or data signal) provided through a data line DL in response to the scan signal provided through a scan line SL. For example, a pixel positioned in an i-th row and a j-th column may emit light with a luminance corresponding to the data voltage provided through a j-th data line in response to the scan signal provided through an i-th scan line. The second pixel PX2 may further include a neural network transistor and may perform a deep learning operation. The first pixel PX1 may not include the neural network transistor. A detailed configuration of the second pixel PX2 will be described below with reference to FIGS. 4 to 6.

The display unit 110 may be driven in a light emitting mode in which light emitting elements of the plurality of first pixels PX1 and the plurality of second pixels PX2 emit light in the first area DA1 and the second area DA2 and an artificial neural network mode in which the light emitting elements of the plurality of first pixels PX1 and the plurality of second pixels PX2 do not emit light. The light emitting mode may be a section (or time period) in which a light emitting element LD is turned off, and the artificial neural network mode may be driven between light emitting sections.

In the light emitting mode, the scan signal, the data voltage, and the emission control signal may be applied to the plurality of first pixels PX1 and the plurality of second pixels PX2. In this case, the light emitting elements of the first pixels PX1 and the second pixels PX2 may generate light having a predetermined luminance corresponding to the data voltage.

In the artificial neural network mode, a neural network control signal may be applied to the plurality of second pixels PX2, so that the neural network transistor of the second pixel PX2 may be operated. In this case, a neural network output voltage (or a neural network output signal) corresponding to a neural network input voltage (or a neural network input signal) may be generated together with the active circuit AC connected to the neural network transistor. Accordingly, in the display device 1000 according to an embodiment, when the pixel does not emit light, by using the second pixels PX2 as an artificial neural network, an operation through deep learning inference can be performed without adding components. Accordingly, manufacturing cost of the display device 1000 may be reduced, and slimming of the display device 1000 may be realized. Operations of the second pixel PX2 and the active circuit AC in the artificial neural network mode will be described in detail below with reference to FIG. 6.

The scan driver 310 may generate the scan signal based on a first control signal SCS and sequentially provide the scan signal to the scan lines SL1 to SLn. When the scan signal is sequentially applied to the scan lines SL1 to SLn, the pixels PX may be selected in units of horizontal lines (or units of pixel rows). Here, the first control signal SCS may include a scan start signal (or scan start pulse), a scan clock signal, and the like, and the first control signal SCS may be provided from the timing controller 350.

The emission control driver 320 may generate the emission control signal based on a second control signal ECS and sequentially provide the emission control signal to the emission control lines EL1 to ELn. In this case, the emission control signal may have a voltage level at which a transistor supplied with the emission control signal can be turned off.

The neural network driver 330 may provide the neural network control signal (or neural network control voltage) to the neural network control lines NL1 to NLn based on a neural network driving control signal NCS. In this case, the neural network control signal may have a voltage level at which the neural network transistor can be turned on. An operation of the neural network transistor will be described later.

In the light emitting mode, the data driver 340 may generate the data voltage (or data signal) based on image data DATA and a third control signal DCS provided from the timing controller 350, and provide the data voltage to the data lines DL1 to DLp. The data voltage provided to the data lines DL1 to DLp may be supplied to the pixels PX selected by the scan signal. Accordingly, the data driver 340 may supply the data voltage to the data lines DL1 to DLp to be synchronized with the scan signal. Here, the third control signal DCS may be a signal for controlling an operation of the data driver 340 and may include a load signal (or a data enable signal) instructing output of an effective data voltage.

In the artificial neural network mode, the data driver 340 may generate the neural network input voltage (or the neural network input signal) based on a weight control signal WCS from the timing controller 350, and may provide the generated neural network input voltage to the data lines DL1 to DLp. The weight control signal WCS may reflect a weight. Here, the weight may be a weight according to characteristic data, logo compensation data, afterimage compensation data, external compensation, and the like of the display panel 100.

The timing controller 350 may receive input image data and a control signal from outside (for example, a graphic processor), and generate the first control signal SCS, the second control signal ECS, the third control signal DCS, the neural network driving control signal NCS, and the weight control signal WCS based on the control signal provided from the outside. Here, the control signal may include a vertical synchronization signal, a horizontal synchronization signal, a clock signal, and the like. In addition, the timing controller 350 may convert the input image data to generate the image data DATA to be provided to the data driver 340.

The timing controller 350 may provide the first control signal SCS to the scan driver 310, provide the second control signal ECS to the emission control driver 320, and provide the third control signal DCS to the data driver 340. The timing controller 350 may provide the neural network driving control signal NCS to the neural network driver 330.

The timing controller 350 may receive the neural network output voltage (or the neural network output signal) from the neural network output lines NOL1 to NOLn, and generate the weight control signal WCS by reflecting the weight corresponding to the provided neural network output voltage. In other words, the weight control signal WCS reflects the weight corresponding to the neural network output voltage. The weight may be a value previously trained in external hardware or software, and may be a predetermined value for inferring through a neural network algorithm.

In addition, the timing controller 350 may provide the weight control signal WCS to the data driver 340. The data driver 340 may provide the neural network input voltage (or the neural network input signal) to the data lines DL1 to DLp based on the weight control signal WCS provided from the timing controller 350. Here, the neural network input voltage may be data in which the weight according to the characteristic data, the logo compensation data, the afterimage compensation data, the external sensing compensation, and the like of the display panel 100 is reflected in neural network output data provided in a previous horizontal line unit (or a previous pixel row line unit). In an embodiment, the display device 1000 may further include a power supply for supplying a predetermined power source to the pixel PX.

Hereinafter, the configuration and operation of the pixel in the display device according to an embodiment will be described with reference to FIGS. 4 and 5.

Figure 4:
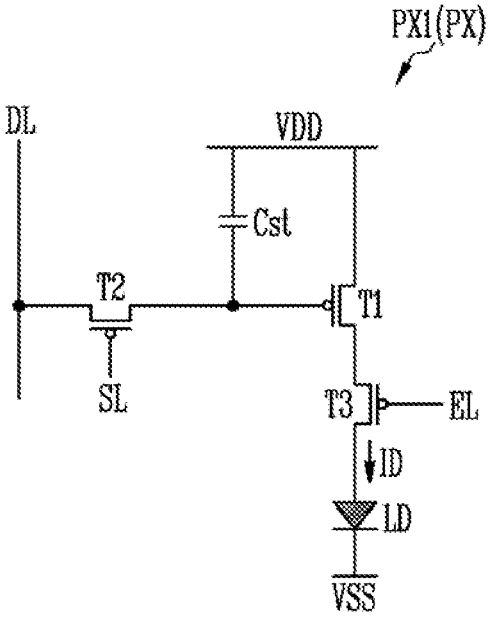
FIGS. 4 and 5 are circuit diagrams illustrating one pixel in the display device according to an embodiment.
Figure 5:
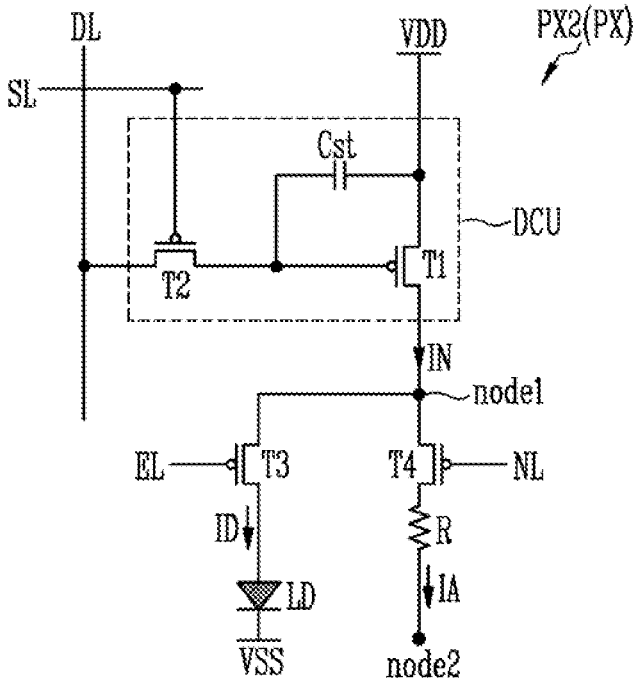

FIGS. 4 and 5 are circuit diagrams illustrating one pixel in the display device according to an embodiment.

One pixel shown in FIG. 4 may be the first pixel PX1 of FIG. 2, and one pixel shown in FIG. 5 may be the second pixel PX2 of FIGS. 2 and 3.

Referring to FIG. 4, the first pixel PX1 may include a first transistor T1, a second transistor T2, a third transistor T3, a storage capacitor Cst, and a light emitting element LD.

The first transistor T1 (or a driving transistor) may be a transistor for driving the light emitting element LD. A first electrode of the first transistor T1 may be connected to a first power source VDD, and a second electrode of the first transistor T1 may be connected to an anode of the light emitting element LD. A gate electrode of the first transistor T1 may be connected to a second electrode of the second transistor T2 (or a first electrode of the storage capacitor Cst). In an embodiment, the first electrode of the first transistor T1 may be a source electrode, and the second electrode of the first transistor T1 may be a drain electrode, but the present invention is not limited thereto. The first transistor T1 may control the amount of driving current ID flowing to the light emitting element LD in response to a voltage applied to the gate electrode of the first transistor T1.

The second transistor T2 (or a switching transistor) may be a transistor that selects the pixel PX in response to the scan signal and activates the pixel PX. A first electrode of the second transistor T2 may be connected to the data line DL, and the second electrode of the second transistor T2 may be connected to the gate electrode of the first transistor T1 (or the first electrode of the storage capacitor Cst). A gate electrode of the second transistor T2 may be connected to the scan line SL. Accordingly, when a signal having a gate-on voltage level is supplied to the scan line SL, the second transistor T2 may be turned on, and the data voltage may be transmitted from the data line DL to the gate electrode of the first transistor T1. In an embodiment, a low-level signal may be supplied to the scan line SL, and the data voltage may be applied to the data line DL at substantially the same time. Accordingly, the second transistor T2 may transfer the data voltage to the gate electrode of the first transistor T1.

The third transistor T3 (or an emission transistor) may be an emission transistor capable of controlling the time that the light emitting element LD emits light. A first electrode of the third transistor T3 may be connected to the second electrode of the first transistor T1, and a second electrode of the third transistor T3 may be connected to the anode of the light emitting element LD. A gate electrode of the third transistor T3 may be connected to an emission control line EL. Accordingly, when a signal having the gate-on voltage level is supplied to the emission control line EL, the third transistor T3 may be turned on, and the driving current ID may be applied to the anode so that the light emitting element LD may generate light having a predetermined luminance.

The storage capacitor Cst may be formed or connected between the first power source VDD and the gate electrode of the first transistor T1. For example, the first electrode of the storage capacitor Cst may be connected to the gate electrode of the first transistor T1, and a second electrode of the storage capacitor Cst may be connected to the first power source VDD. The storage capacitor Cst may store a voltage of the gate electrode of the first transistor T1 (in other words, the data voltage).

The anode of the light emitting element LD may be connected to the first power source VDD through the first transistor T1, and a cathode of the light emitting element LD may be connected to a second power source VSS. The light emitting element LD may generate light having a predetermined luminance in response to the driving current ID supplied through the first transistor T1. The light emitting element LD may be composed of an organic light emitting diode or an inorganic light emitting diode such as a micro light emitting diode (LED) and a quantum dot light emitting diode. In addition, the light emitting element LD may be a light emitting element composed of a combination of an organic material and an inorganic material. In FIG. 4, the first pixel PX is shown as including one light emitting element LD. However, according to another embodiment, the first pixel PX (and the second pixel PX2) may include a plurality of light emitting elements LD, and the plurality of light emitting elements LD may be connected to each other in series, in parallel, or in series and parallel.

Each of the first transistor T1 and the second transistor T2 may include a silicon semiconductor and may be, for example, a P-type transistor. However, the first transistor T1 and the second transistor T2 are not limited thereto. At least one of the first transistor T1 and the second transistor T2 may include an oxide semiconductor or may be implemented as an N-type transistor.

Referring to FIG. 5, the second pixel PX2 may include a driving circuit unit DCU including at least one transistor, at least one light emitting element LD, a third transistor T3, a fourth transistor T4, and at least one resistor R.

The driving circuit unit DCU may include the first transistor T1, the second transistor T2, and the storage capacitor Cst described above. Each of the third transistor T3 and the fourth transistor T4 may include a silicon semiconductor and may be, for example, a P-type transistor. However, the third transistor T3 and the fourth transistor T4 are not limited thereto. At least one of the third transistor T3 and the fourth transistor T4 may include an oxide semiconductor or may be implemented as an N-type transistor.

The second electrode of the first transistor T1 may be connected to a first node node 1. In the light emitting mode, the first transistor T1 may control the driving current ID flowing to the light emitting element LD through the third transistor T3, which is connected to the first node node 1, in response to the voltage applied to the gate electrode of the first transistor T1. In the artificial neural network mode, the first transistor T1 may control a first node current IN applied to the first node node 1 in response to a voltage applied to the gate electrode of the first transistor T1. In this case, the voltage applied to the gate electrode of the first transistor T1 may be a neural network input voltage. The first node current IN may be directly applied to the light emitting element LD in the light emitting mode (here, the first node current IN may be the driving current ID). The first node current IN may be directly applied to the fourth transistor T4 without being applied to the light emitting element LD in the artificial neural network mode (here, the first node current IN may be an active current IA).

In the light emitting mode, the second transistor T2 may transmit the data voltage for emitting light to the gate electrode of the first transistor T1 in response to the scan signal. In the artificial neural network mode, the second transistor T2 may transmit the neural network input voltage (or the neural network input signal) for the neural network algorithm to the gate electrode of the first transistor T1 in response to the scan signal.

In the light emitting mode, when the data voltage is applied to the first electrode of the storage capacitor Cst, the storage capacitor Cst may store a voltage corresponding to a difference from the first power source VDD applied to the second electrode of the storage capacitor Cst. In other words, the difference may be a difference between the data voltage applied to the first electrode of the storage capacitor Cst and the first power source VDD applied to the second electrode of the storage capacitor Cst. Accordingly, in the light emitting mode, the second pixel PX2 may generate the driving current ID, and the driving current ID may flow to the light emitting element LD.

The third transistor T3 (or an emission transistor) may be an emission transistor capable of controlling the time that the light emitting element LD emits light. A first electrode of the third transistor T3 may be connected to the first node node 1, and a second electrode of the third transistor T3 may be connected to an anode of the light emitting element LD. A gate electrode of the third transistor T3 may be connected to an emission control line EL. Accordingly, when a signal having a gate-on voltage level is supplied to the emission control line EL, the third transistor T3 may be turned on, and the driving current ID may be applied to the anode so that the light emitting element LD may generate light having a predetermined luminance. In a period in which the third transistor T3 is turned off, a first node current IN output from the first transistor T1 may flow to the fourth transistor T4.

The fourth transistor T4 (or a neural network transistor) may be a transistor driven in the artificial neural network mode. A first electrode of the fourth transistor T4 may be connected to the first node node 1, and a second electrode of the fourth transistor T4 may be connected to a second node node 2 through at least one resistor R. A gate electrode of the fourth transistor T4 may be connected to a neural network control line NL. Accordingly, when a signal having the gate-on voltage level is supplied to the neural network control line NL, the fourth transistor T4 may be turned on, and an active current IA corresponding to the neural network input voltage may be generated from the first node node 1 to the second node node 2. In other words, in response to a neural network control signal provided through the neural network control line NL, the fourth transistor T4 may output the active current IA by reflecting the neural network input voltage provided through the data line DL.

The anode of the light emitting element LD may be connected to the first power source VDD through the first transistor T1 and the third transistor T3, and a cathode of the light emitting element LD may be connected to the second power source VSS. In the light emitting mode, the light emitting element LD may generate light having a predetermined luminance in response to the driving current ID supplied through the first transistor T1 and the third transistor T3. In the artificial neural network mode, the driving current ID may not be applied to the light emitting element LD, and thus, the light emitting element LD may not generate light.

In an embodiment, the structure of the one pixel PX of the display device 1000 is not limited to those shown in FIGS. 4 and 5 and may be variously changed. For example, the one pixel PX may further include at least one transistor such as a compensation transistor for compensating a threshold voltage of the first transistor T1 and an initialization transistor for initializing the gate electrode of the first transistor T1.

Hereinafter, a structure when the display device according to an embodiment is driven in the artificial neural network mode will be described with reference to FIG. 6.

Figure 6:
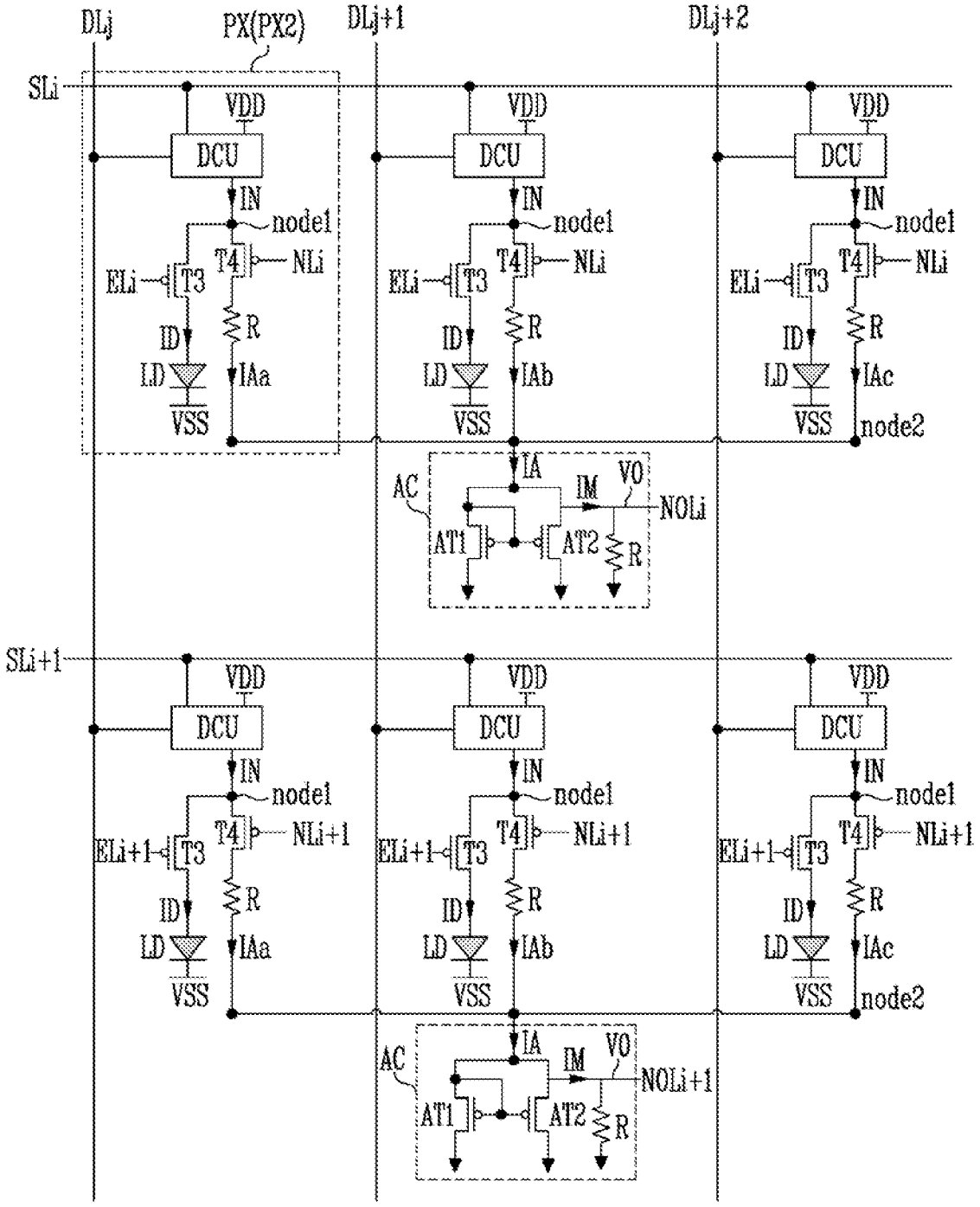
FIG. 6 is a circuit diagram illustrating an example in which a plurality of pixels are connected in the display device according to an embodiment.

FIG. 6 is a circuit diagram illustrating an example in which a plurality of pixels are connected in the display device according to an embodiment.

Referring to FIG. 6, the display device according to an embodiment may include the plurality of pixels PX and the active circuit AC. Each pixel PX shown in FIG. 6 may represent the second pixel PX2 of FIG. 5. Hereinafter, the pixel PX refers to the second pixel PX2. The display device according to an embodiment may include only the second pixel PX2. In an embodiment, a plurality of second pixels PX2 and active circuits AC shown in FIG. 6 may be included in one pixel block. However, according to an embodiment, the positions and/or the number of the second pixels PX2 and the active circuits AC included in the one pixel block may be variously modified.

The plurality of pixels PX positioned in the i-th row may be connected to the active circuit AC through the second node node 2. In other words, in each pixel PX of the i-th row, the second electrode of the fourth transistor T4 may be connected to the active circuit AC through the resistor R. The active circuit AC may be connected between the second node node 2 and an output terminal VO, and the output terminal VO may be connected to a neural network output line NOL. As can be seen, one active circuit AV may be provided for each row of pixels PX.

In the present embodiment, the active circuit AC may correspond to an activation function for applying the above-described artificial neural network algorithm.

In an embodiment, the active circuit AC may be implemented as a current mirror circuit. The current mirror circuit may include a plurality of transistors, and may supply a current having a desired current value to a desired circuit. In the present embodiment, the current mirror circuit may include two transistors AT1 and AT2, each of which is shown to be a P-type transistor. According to an embodiment, the number of transistors constituting the current mirror circuit may be changed, and each transistor may be implemented as an N-type transistor.

In the active circuit AC, a first electrode and a gate electrode of a first active transistor AT1 may be connected to the second node node 2, and a gate electrode of a second active transistor AT2 may be connected to the gate electrode and the first electrode of the first active transistor AT1. A first electrode of the second active transistor AT2 may be connected to the second node node 2. The gate electrode of the second active transistor AT2 may be connected to the second node node 2.

Driving voltages of the first and second active transistors AT1 and AT2 may be determined according to a voltage of the second node node 2. A current applied to the first electrode of the second active transistor AT2 may have the same value as a current applied to the first electrode of the first active transistor AT1. In other words, a mirror current IM may have the same value as the active current IA. Accordingly, a voltage of the output terminal VO may be determined by a value obtained by multiplying the active current IA by the resistance R.

The output terminal VO may be connected to the neural network output line NOL, and the voltage of the output terminal VO may be provided to the timing controller 350 (refer to FIGS. 2 and 3) through the neural network output line NOL. In other words, the active circuit AC may provide the neural network output voltage to the neural network output line NOL by calculating active currents IA corresponding to the plurality of pixels PX connected to the active circuit AC. For example, the active current IA for each of the pixels PX connected to the active circuit AC may be determined. Thereafter, the timing controller 350 may generate the weight control signal WCS by reflecting the weight corresponding to the provided neural network output voltage. The timing controller 350 may provide the weight control signal WCS to the data driver 340. The data driver 340 may generate the neural network input signal based on the weight control signal WCS, and provide the neural network input signal through the data line DL connected to the plurality of pixels PX positioned in an $(i_{+})$th row. In other words, the neural network input signal is provided to the plurality of pixels PX of a next row. The plurality of pixels PX positioned in the (i+1)th row may be driven in the same manner as the plurality of pixels PX positioned in the i-th row.

Hereinafter, the artificial neural network will be described with reference to FIG. 7.

Figure 7:
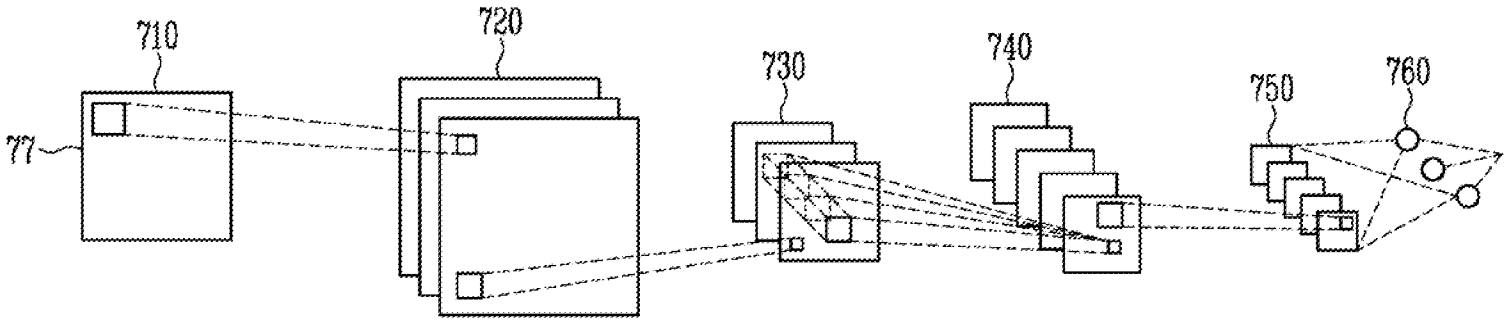
FIG. 7 is a diagram schematically illustrating an artificial neural network implemented in the display device according to an embodiment.
Figure 8:
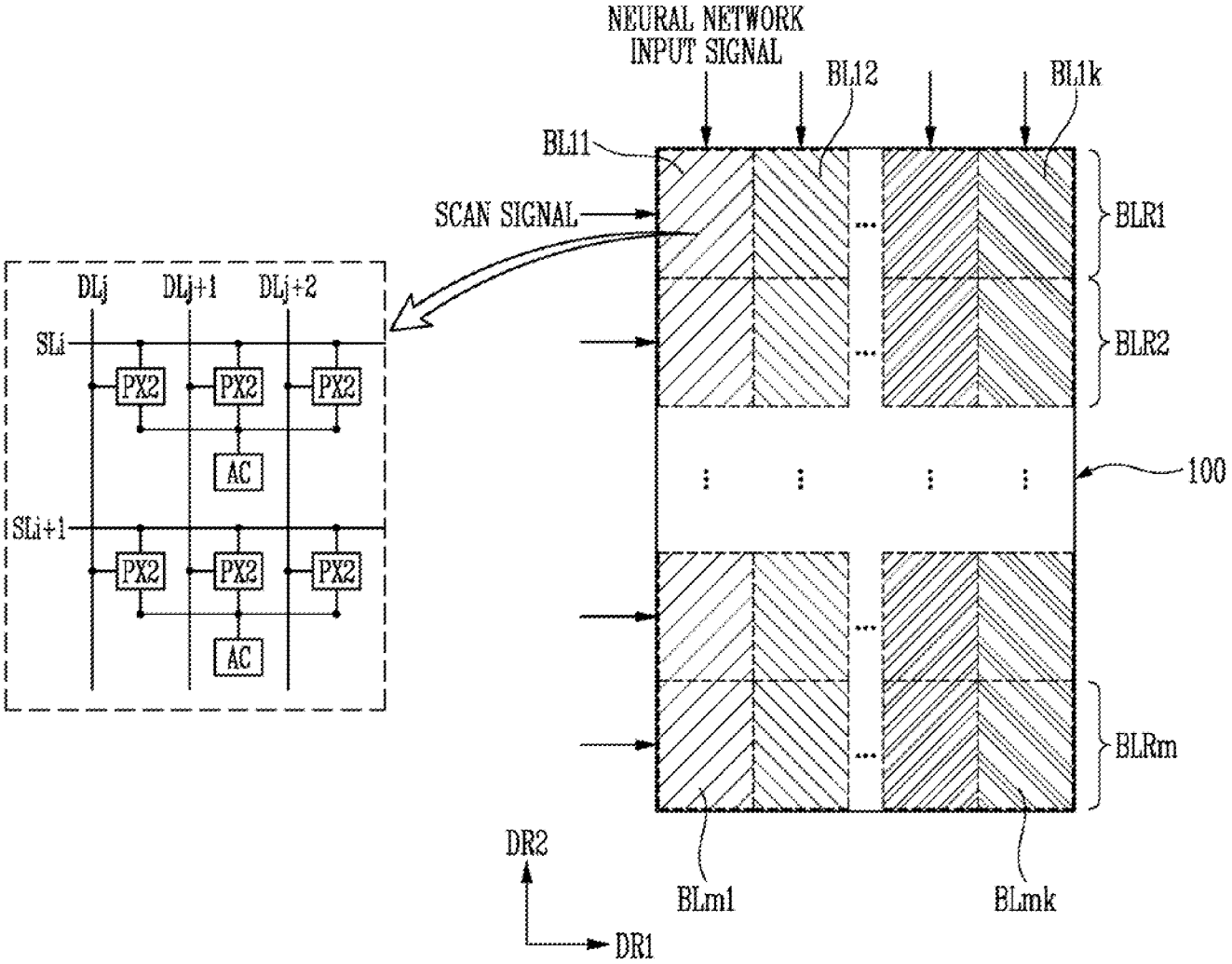
FIGS. 8, 9, 10 and 11 are plan views illustrating divided areas in a display panel according to an embodiment.

FIG. 7 is a diagram schematically illustrating an artificial neural network implemented in the display device according to an embodiment.

Referring to FIG. 7, the display device according to an embodiment may be implemented as a convolutional neural network (CNN). The convolutional neural network may be used in the field of detecting and classifying input images. The convolutional neural network may generate a unique feature map based on input data and output data according to the feature map. The present invention is not limited thereto. According to embodiments, the artificial neural network may correspond to a recurrent neural network (RNN), a deep belief network (DBN), a restricted Boltzmann machine (RBM), and the like.

The convolutional neural network may include a plurality of layers. In other words, the convolutional neural network may include an input layer 710, at least one convolutional layer 720 and 740, at least one pooling layer 730 and 750, and a fully connected layer 760.

The input layer 710 may include a plurality of pixel blocks, and may correlate data corresponding to each pixel block to a first convolution layer 720. In an embodiment, the input layer 710 may correspond to the display panel 100 (refer to FIG. 1) (or the display unit 110 (refer to FIGS. 2 and 3)), and the pixels PX disposed on the display panel 100 may correspond to neurons constituting the artificial neural network. Here, each pixel block may include the second pixels PX2 and the active circuits AC described with reference to FIG. 6.

The first convolution layer 720 may be a set of result values (for example, characteristic values of pixels PX) obtained by performing a convolution operation on data of the input layer 710. The first convolution layer 720 may extract the characteristic values of the pixels PX through the convolution operation.

In an embodiment, the first convolution layer 720 may include the characteristic values of the pixels PX calculated through the second pixel PX2 and the active circuit AC shown in FIG. 6. Here, the characteristic values of the pixels PX may be values of the pixels PX corresponding to the characteristic data, the logo compensation data, the afterimage compensation data, the external compensation, and the like of the display panel 100.

Data of the pixels PX positioned in at least one pixel block of the input layer 710 may correspond to a result value of a first convolution layer of the first convolution layer 720.

The first convolutional layer 720 may include at least one feature map. Values corresponding to the data of the pixels PX (for example, the characteristic values of the pixels PX) positioned in at least one pixel block of the input layer 710 on which the convolution operation is performed using a kernel 77 (or filter) may be stored in each feature map. For example, in an embodiment, since one pixel PX includes a red sub-pixel, a green sub-pixel, and a blue sub-pixel emitting red light, green light, and blue light, respectively, the first convolution layer 720 may include three feature maps in which characteristic values corresponding to each sub-pixel are stored.

First and second pooling layers 730 and 750 may simplify output information of first and second convolutional layers 720 and 740. In other words, the first and second pooling layers 730 and 750 may reduce the size of the feature map by down-sampling at least one feature map.

The first and second pooling layers 730 and 750 may perform a maximum pooling operation for extracting a maximum value among values of the feature map. In addition, the first and second pooling layers 730 and 750 may perform an average pooling operation for extracting an average value among the values of the feature map.

The second convolution layer 740 may perform the convolution operation on the feature map down-sampled through the first pooling layer 730. Thereafter, the feature map may be down-sampled again through the second pooling layer 750. In other words, the convolutional neural network may filter and output an optimal feature from the input layer 710 by repeatedly performing the convolution operation and the pooling operation in a plurality of layers, and may derive an output value through output final features.

The fully connected layer 760 may be a layer in which all previous layers and values corresponding to the characteristic values of the pixels PX are connected. The fully connected layer 760 may output an output value calculated through the first and second convolutional layers 720 and 740 and the first and second pooling layers 730 and 750. The fully connected layer 760 may serve as a classifier and may be implemented as an output layer.

In an embodiment, since the display device 1000 can be driven using the convolutional neural network, operations can be performed using two-dimensional data and three-dimensional data.

Hereinafter, how the convolutional neural network is implemented in the display device according to an embodiment will be described with reference to FIGS. 8 to 11.

FIGS. 8 to 11 are plan views illustrating divided areas in a display panel according to an embodiment.

Referring to FIGS. 8 to 11, a display panel 100 according to an embodiment may have the same configuration as the display panel 100 described with reference to FIG. 1.

The display panel 100 may be divided into a plurality of pixel blocks BL11 to BLmk, and one pixel block among the plurality of pixel blocks BL11 to BLmk may include a plurality of pixels and at least one active circuit. Here, the plurality of pixels and the at least one active circuit may correspond to the plurality of second pixels PX2 and the active circuit AC described with reference to FIG. 6.

Referring to FIGS. 2, 3, and 6 together, in the artificial neural network mode, the display device according to an embodiment may supply the scan signal to the scan line SL connected to at least one pixel block among the plurality of pixel blocks BL11 to BLmk, and supply the neural network input signal to the data line DL connected to at least one pixel block among the plurality of pixel blocks BL11 to BLmk.

In other words, in an embodiment, when the scan signal is applied in the first direction DR1 and the neural network input signal to which a weight corresponding to the scan signal is reflected is applied in the second direction DR2, the plurality of pixel blocks BL11 to BLmk may be driven in the artificial neural network mode. For example, referring to FIG. 6, when the scan signal and the neural network input voltage are supplied to a scan line SLi of the i-th row and a data line DLj of the j-th column, respectively, the display device 1000 according to an embodiment may selectively drive a pixel block connected thereto in the artificial neural network mode.

Referring to FIGS. 8 to 11, the plurality of pixel blocks BL11 to BLmk may be arranged in a matrix form in the first direction DR1 and the second direction DR2. For example, the plurality of pixel blocks BL11 to BLmk may include k pixel blocks arranged in the first direction DR1 and m pixel blocks arranged in the second direction DR2, where k and m may be natural numbers. The number of pixel blocks BL11 to BLmk may be variously changed according to the size of the convolution, the size of the neural network algorithm, and the like.

Among the plurality of pixel blocks BL11 to BLmk, pixel blocks arranged in the first direction DR1 may constitute row pixel blocks BLR1 to BLRm. Each of the row pixel blocks BLR1 to BLRm may be arranged to be adjacent to each other in the second direction DR2. In addition, pixel blocks constituting each of the row pixel blocks BLR1 to BLRm may be arranged in parallel in the first direction DR1 to be adjacent to each other (or so as not to overlap each other). Such an arrangement of the pixel blocks may be referred to as a seamless arrangement.

Figure 9:
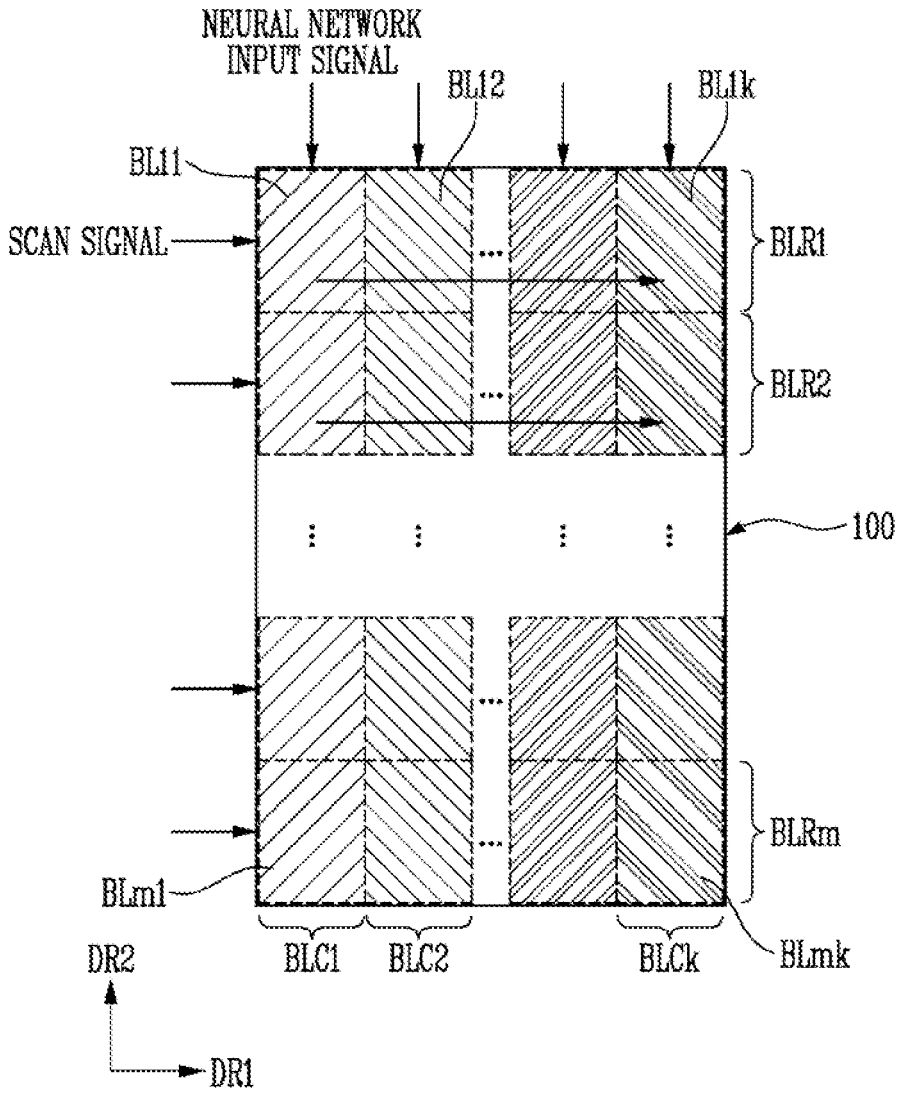

Referring to FIG. 9, the row pixel blocks BLR1 to BLRm arranged in parallel along the first direction DR1 may be sequentially driven in the artificial neural network mode along the first direction DR1. For example, the row pixel blocks BLR1 to BLRm may be sequentially driven in the artificial neural network mode along the first direction DR1 in a first row pixel block BLR1, and may be sequentially driven in the artificial neural network mode along the first direction DR1 in a second row pixel block BLR2.

Figure 10:
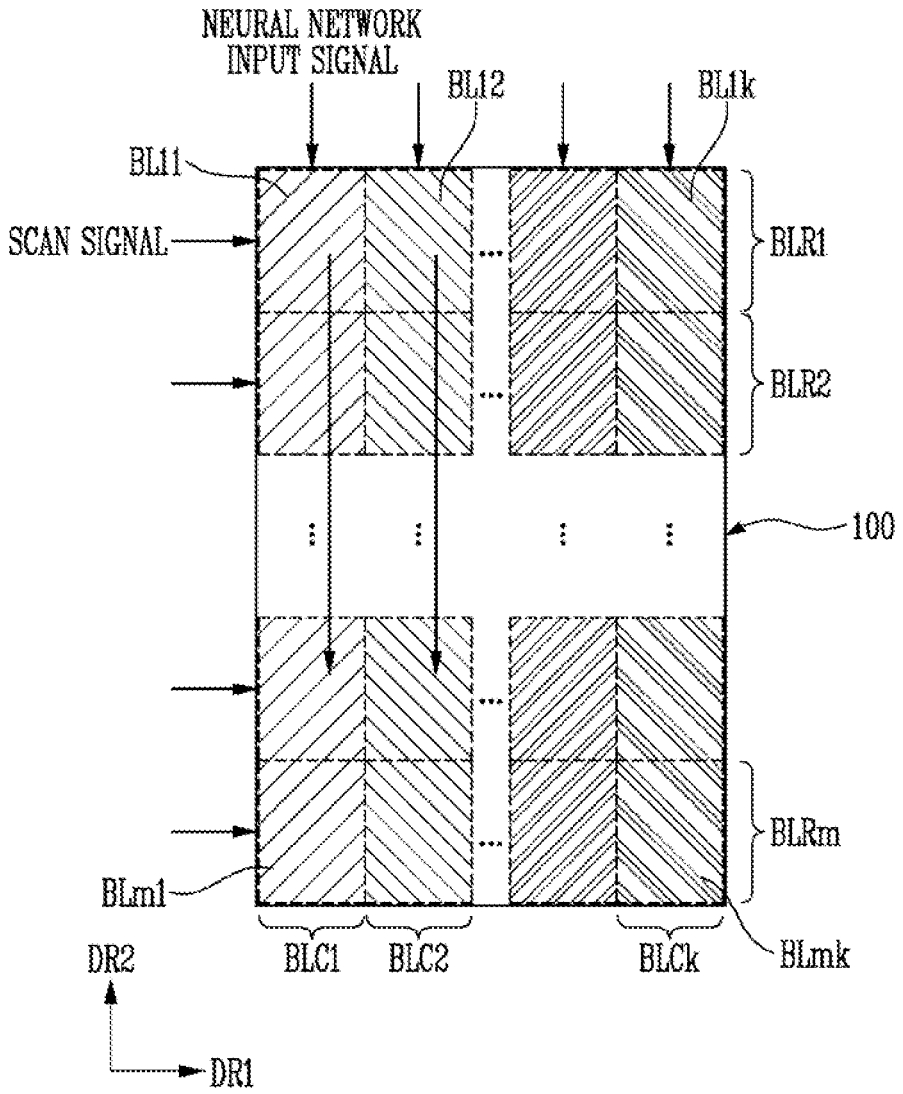

Referring to FIG. 10, column pixel blocks BLC1 to BLCk arranged in parallel along the second direction DR2 may be sequentially driven in the artificial neural network mode along the second direction DR2. For example, the column pixel blocks BLC1 to BLCk may be sequentially driven in the artificial neural network mode along the second direction DR2 in a first column pixel block BLC1, and may be sequentially driven in the artificial neural network mode along the second direction DR2 in a second column pixel block BLC2.

Here, each of the plurality of pixel blocks BL11 to BLmk may correspond to at least one pixel block of the input layer 710 described with reference to FIG. 7. For example, a first pixel block BL11 may correspond to at least one input layer 710 to be driven as the convolutional neural network in the artificial neural network mode. Accordingly, characteristic values calculated through the plurality of pixels PX and the active circuit AC disposed in the first pixel block BL11 may be operated through the first and second convolution layers 720 and 740, the first and second pooling layers 730 and 750, and the like, and calculated as an output value in the fully connected layer 760. Thereafter, a second pixel block BL12 may correspond to at least one input layer 710 to be driven as the convolutional neural network in the artificial neural network mode. Accordingly, characteristic values calculated through the plurality of pixels PX and the active circuit AC disposed in the second pixel block BL12 may be operated through the first and second convolution layers 720 and 740, the first and second pooling layers 730 and 750, and the like, and calculated as the output value in the fully connected layer 760.

In other words, the first row pixel block BLR1 may be sequentially driven in the artificial neural network mode along the first direction DR1, and then, each block included in the second row pixel block BLR2 may also be sequentially driven in the artificial neural network mode along the first direction DR1.

According to the embodiments, the display panel 100 may be divided into the plurality of pixel blocks BL11 to BLmk, and the corresponding characteristic values may be calculated by sequentially or selectively driving the pixel blocks BL11 to BLmk. Therefore, compared to a case where the entire display panel 100 is utilized, deterioration of transistors, elements, and the like can be dispersed and prevented.

Figure 11:
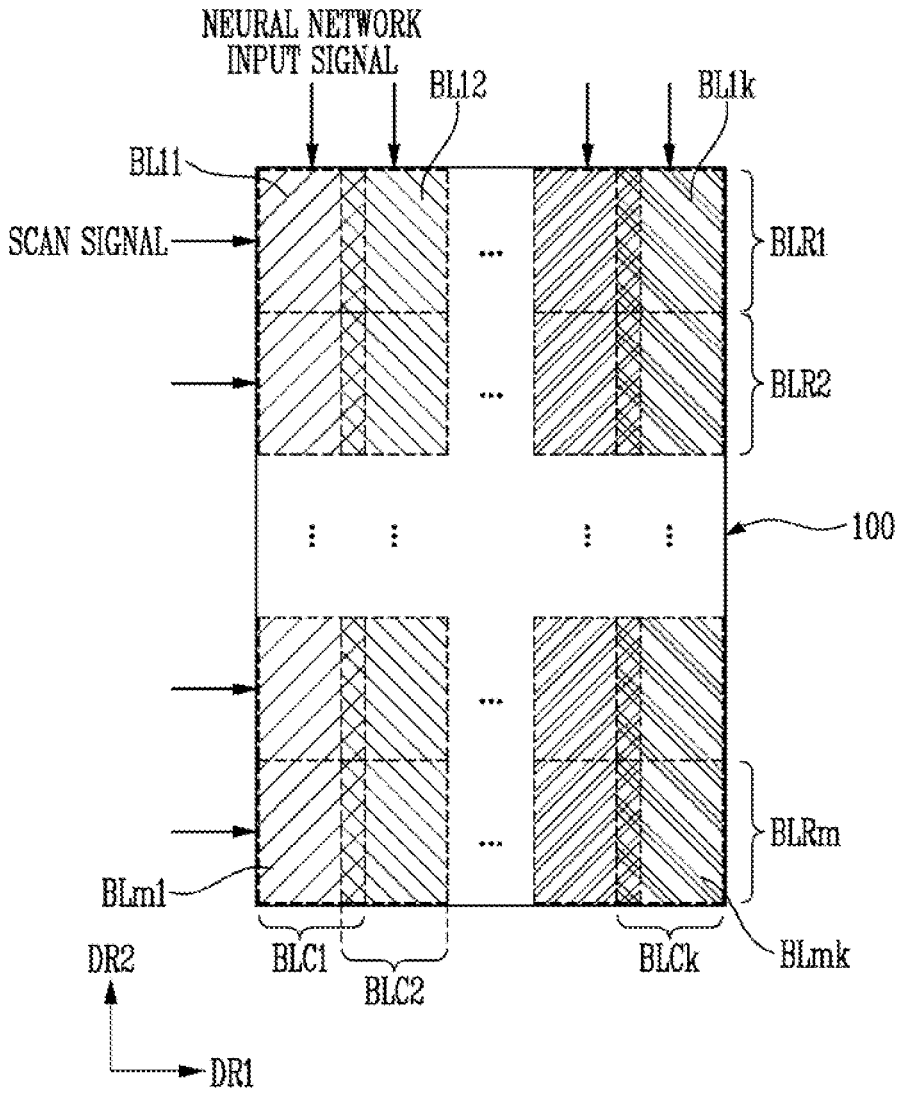

Referring to FIG. 11, the plurality of pixel blocks BL11 to BLmk may be arranged in a matrix form in the first direction DR1 and the second direction DR2. For example, the plurality of pixel blocks BL11 to BLmk may include k pixel blocks arranged in the first direction DR1 and m pixel blocks arranged in the second direction DR2, where k and m may be natural numbers.

Each of the row pixel blocks BLR1 to BLRm may be arranged to be adjacent to each other in the second direction DR2. Blocks constituting each of the row pixel blocks BLR1 to BLRm may be arranged along the first direction DR1 to overlap at least partially in the first direction DR1. Such an arrangement of the blocks may be referred to as an overlap arrangement. The arrangement of the blocks constituting one row pixel block may be changed according to the number of convolutional dimensions.

The row pixel blocks BLR1 to BLRm arranged in parallel along the first direction DR1 may be sequentially driven in the artificial neural network mode along the first direction DR1. For example, the row pixel blocks BLR1 to BLRm may be sequentially driven in the artificial neural network mode along the first direction DR1 in the first row pixel block BLR1. In this case, in an area where the first block BL11 and the second block BL12 at least partially overlap, the characteristic values of the pixels PX may be reflected to each other. In other words, when the blocks are arranged to overlap each other in a row pixel block, the characteristic values of each pixel PX may be reflected in each other's calculated values in the overlapping area when driven in the artificial neural network mode along the first direction DR1.

Here, each of the plurality of pixel blocks BL11 to BLmk may correspond to at least one pixel block of the input layer 710 described with reference to FIG. 7. For example, the first pixel block BL11 may correspond to at least one input layer 710 to be driven as the convolutional neural network in the artificial neural network mode. Accordingly, characteristic values calculated through the plurality of pixels PX and the active circuit AC disposed in the first pixel block BL11 may be operated through the first and second convolution layers 720 and 740, the first and second pooling layers 730 and 750, and the like, and calculated as an output value in the fully connected layer 760. In this case, characteristic values calculated through the plurality of pixels PX and the active circuit AC disposed in the second block BL12 may also be reflected in an output value of the second block BL12.

In addition, the column pixel blocks BLC1 to BLCk arranged in parallel along the second direction DR2 may be sequentially driven in the artificial neural network mode along the second direction DR2. For example, the column pixel blocks BLC1 to BLCk may be sequentially driven in the artificial neural network mode along the second direction DR2 in the first column pixel block BLC1, and may be sequentially driven in the artificial neural network mode along the second direction DR2 in the second column pixel block BLC2.

According to the embodiments, the display panel 100 may be divided into the plurality of pixel blocks, and the corresponding characteristic values may be calculated by sequentially or selectively driving the pixel blocks. Therefore, compared to the case where the entire display panel 100 is utilized, deterioration of transistors, elements, and the like can be dispersed and prevented.

Effects are not limited to the above-described effect, and additional effects are included within the scope of the present specification.

What is claimed is:

1. A display device, comprising:

a plurality of pixel blocks including a plurality of pixels connected to a plurality of scan lines and a plurality of data lines, respectively, and at least one active circuit; and a data driver for supplying a data voltage to the plurality of data lines in a light emitting mode and for supplying a neural network input signal to the plurality of data lines in an artificial neural network mode, wherein a scan signal is supplied to a scan line connected to at least one pixel block among the plurality of pixel blocks in the artificial neural network mode, and the neural network input signal is supplied to a data line connected to the at least one pixel block in the artificial neural network mode.

2. The display device of claim 1, wherein the plurality of pixel blocks are arranged in a matrix in a first direction and a second direction perpendicular to the first direction.

3. The display device of claim 2, wherein the plurality of pixel blocks are arranged adjacent to each other in the first direction, and wherein the plurality of pixel blocks are driven in the artificial neural network mode in the first direction.

4. The display device of claim 2, wherein the plurality of pixel blocks are arranged adjacent to each other in the second direction, and wherein the plurality of pixel blocks are driven in the artificial neural network mode in the second direction.

5. The display device of claim 2, wherein some of the pixel blocks among the plurality of pixel blocks overlap at least partially in the first direction, and wherein the plurality of pixel blocks are driven in the artificial neural network mode in the first direction.

6. The display device of claim 1, wherein the artificial neural network mode uses a convolutional neural network.

7. The display device of claim 6, wherein the convolutional neural network includes an input layer, a first convolution layer, a first pooling layer, and a fully connected layer.

8. The display device of claim 7, wherein the input layer includes the plurality of pixel blocks and correlates data corresponding to one pixel block among the plurality of pixel blocks to the first convolution layer.

9. The display device of claim 8, wherein the first convolution layer includes characteristic values of pixels on which a convolution operation is performed on pixel values of the input layer, and wherein the characteristic values of the pixels are values calculated using the plurality of pixels and at least one of the active circuits in the first convolution layer.

10. The display device of claim 9, wherein the first convolution layer includes at least one feature map, and wherein the characteristic values of the pixels on which the convolution operation is performed using a kernel are stored in the at least one feature map.

11. The display device of claim 10, wherein the first pooling layer down-samples the at least one feature map, and wherein the fully connected layer outputs an output value calculated using the first convolution layer and the first pooling layer.

12. A display device, comprising:

a plurality of pixel blocks including a plurality of pixels connected to a plurality of scan lines and a plurality of data lines, respectively, and at least one active circuit;

a data driver for supplying a data voltage to the plurality of data lines in a first mode and for supplying a neural network input signal to the plurality of data lines in a second mode; and a timing controller for supplying a weight control signal generated by reflecting a predetermined weight for performing a deep learning operation using at least one pixel among the plurality of pixels to the data driver, wherein, a scan signal is supplied to a scan line connected to at least one pixel block among the plurality of pixel blocks in the second mode, and the neural network input signal is supplied to a data line connected to the at least one pixel block in the second mode.

13. The display device of claim 12, wherein the plurality of pixels includes a plurality of first pixels and a plurality of second pixels, wherein the plurality of first pixels and the plurality of second pixels emit light in the first mode, and wherein the plurality of second pixels performs the deep learning operation in the second mode.

14. The display device of claim 13, wherein the active circuit is connected to the plurality of second pixels, wherein the active circuit receives an active current corresponding to the deep learning operation from the plurality of second pixels connected thereto, and supplies a neural network output voltage corresponding to the active current to the timing controller, and wherein the timing controller generates the weight control signal by reflecting the predetermined weight to the neural network output voltage.

15. The display device of claim 14, wherein the plurality of pixel blocks are arranged in a matrix in a first direction and a second direction perpendicular to the first direction.

16. The display device of claim 15, wherein the plurality of pixel blocks are arranged adjacent to each other in the first direction, and wherein the plurality of pixel blocks are driven in the second mode in the first direction.

17. The display device of claim 15, wherein the plurality of pixel blocks are arranged adjacent to each other in the second direction, and wherein the plurality of pixel blocks are driven in the second mode in the second direction.

18. The display device of claim 15, wherein some of the pixel blocks among the plurality of pixel blocks overlap at least partially in the first direction, and wherein the plurality of pixel blocks are driven in the second mode in the first direction.

19. The display device of claim 12, wherein the second mode uses a convolutional neural network, and wherein the convolutional neural network includes an input layer, a first convolution layer, a first pooling layer, and a fully connected layer.

20. The display device of claim 19, wherein the input layer includes the plurality of pixel blocks and correlates data corresponding to one pixel block among the plurality of pixel blocks to the first convolution layer.

* * * * *